United States Patent [19]

Kume et al.

[11] Patent Number: 4,495,437

[45] Date of Patent: Jan. 22, 1985

[54] GRID APPARATUS FOR USE WITH A COLOR CATHODE RAY TUBE

[75] Inventors: Hisao Kume, Aichi; Takahide Sanma, Ohgaki, both of Japan

[73] Assignee: Sony Corporation, Tokyo, Japan

[21] Appl. No.: 411,018

[22] Filed: Aug. 24, 1982

[30] Foreign Application Priority Data

Aug. 26, 1981 [JP] Japan ..... 56-133791

[51] Int. Cl.[3] ..... H01J 29/07; H01J 19/48

[52] U.S. Cl. ..... 313/403; 313/407; 313/269; 313/348

[58] Field of Search ..... 313/407, 403, 404, 269, 313/348

[56] References Cited

U.S. PATENT DOCUMENTS 3,638,063 1/1972 Tachikawa et al. ..... 313/269 X 4,291,253 9/1981 Ohkoshi et al. ..... 313/269 X

*Primary Examiner*—Palmer Demeo

*Attorney, Agent, or Firm*—Hill, Van Santen, Steadman & Simpson

[57] ABSTRACT

A grid apparatus for use with a color cathode ray tube is described, having a pair of opposing frame members, and a pair of arm portions respectively welded at free ends thereof to the pair of opposing frame members for mechanically connecting the pair of opposing frame members, and for stretching the grid elements with a predetermined tension in cooperation with the pair of opposing frame members, in which each of the pair of arm portions is curved generally as a U-shape in substantially one plane. Both ends of the arm portions are respectively connected to the pair of opposing frame members at positions outside from their Bessel points, and the plane in which each of the pair of arm portions is arranged to respectively widened rearward with an angle from 45° to 65° with respect to a surface perpendicular to an axis of the grid apparatus.

2 Claims, 8 Drawing Figures

GRID APPARATUS FOR USE WITH A COLOR CATHODE RAY TUBE

BACKGROUND OF THE INVENTION

1. Field of the Invention

This invention relates generally to so-called aperture grilles, and more particularly relates to a grid apparatus for use with a color cathode ray tube.

2. Description of the Prior Art

In an ordinary color cathode ray tube, a grid apparatus is positioned adjacent to and opposed to the phosphor screen of the color cathode ray tube to determine a landing position of an electron beam on the screen. In a color cathode ray tube such as a Trinitron (Registered Trademark) tube, as shown in FIG. 1, a funnel portion 2 having a neck portion 1 is connected along its open end with a panel portion 3, thus composing an evacuated envelope 4. Within the envelope 4 near the panel portion 3 there is located a grid apparatus 7 called generally, for example, aperture grille or shadow mask opposed to a phosphor screen 6 formed on the inner surface of face plate 5 of the envelope 4. By this grid apparatus 7, each electron beam 9 corresponding to respective colors of, for example, red, green and blue (in the figure only one electron beam is illustrated) emitted from an electron gun 8 provided within the neck portion 1 impinges on the phosphor stripe corresponding to the desired color on the phosphor screen 6.

As, for example, shown in FIG. 2, this grid apparatus 7 comprises a frame 10 composed of a pair of spaced frame members 10*a* and 10*b* opposing each other, and left and right arm portions 10*c* and 10*d* supported therebetween. Across the front surfaces of the opposing frame members 10*a* and 10*b* of the frame 10, namely, the end surfaces of the frame 10, namely, the end surface thereof opposing the phosphor screen 6 (in FIG. 1), there is stretched a grid element 11. This grid element 11 is made of, for example, a thin metal plate, through which a number of slits are bored in parallel to one another with a predetermined interval in the same direction by selective etching technique. Both end edges of the thin metal plate in the extended direction of the slits are welded to the respective end surfaces of the front side of the frame members 10*a* and 10*b* in the frame 10. When the color cathode ray tube is placed in operation, the grid element 11 is apt to be expanded by heat generated due to, for example, the electron beam impinged thereon. In order to avoid slack and preserve a stretched state with a predetermined tension between the frame members 10*a* and 10*b*, the grid element 11 has to be stretched between the frame members 10*a* and 10*b* with a predetermined tension distribution beforehand. To this end, when the grid element 11 is stretched between both the frame members 10*a* and 10*b* or the thin metal plate with the aforesaid slits is attached therebetween, both of the frame members 10*a* and 10*b* are applied with loads from the outsides thereof, namely, from the sides opposing to the sides where both of the frame members 10*a* and 10*b* are facing each other so as to bend the frame members 10*a* and 10*b* inwardly, in other words, a so-called turn buckle or vise is applied thereto. Under this bent state, the grid element 11 is welded, and hence fixed, to both of the frame members 10*a* and 10*b*.

In order that the frame 10 may have mechanical strength enough to withstand the turn buckle upon the stretching operation and the loads due to the tension of the grid element 11 welded to the frame members and in order to obtain turn buckle and tension, with each having a predetermined tension distribution, the shapes and sizes of the respective frame members 10*a* and 10*b* and left and right arm portions 10*c* and 10*d*, and in addition, the connection positions of the left and right arm portions 10*c* and 10*d* to the frame members 10*a* and 10*b* are suitably selected.

The frame members 10*a* and 10*b* of the frame 10 are preferably each made of steel material such as a carbon steel and the like formed as, for example, L-shape in cross-section, while each of the left and right arm portions 10*c* and 10*d* of the frame 10 is preferably formed of a hollow metal tubular pipe to provide strength with a reduced weight. These left and right arm portions 10*c* and 10*d* are respectively comprised of both end portions $\mathbf{10}_{c1}$, $\mathbf{10}_{c2}$ and $\mathbf{10}_{d1}$, $\mathbf{10}_{d2}$, each being extended from the frame members $\mathbf{10}_a$ and $\mathbf{10}_b$ to the rearwards, and middle portions $\mathbf{10}_{c3}$ and $\mathbf{10}_{d3}$ curved horizontally to the outside from these end portions $\mathbf{10}_{c1}$, $\mathbf{10}_{c2}$, and $\mathbf{10}_{d1}$, $\mathbf{10}_{d2}$. The middle portions $\mathbf{10}_{c3}$ and $\mathbf{10}_{d3}$ are also curved as U-shapes within the planes intersecting the planes determined by both end portions $\mathbf{10}_{c1}$, $\mathbf{10}_{c2}$, and $\mathbf{10}_{d1}$, $\mathbf{10}_{d2}$, at predetermined angles. As a whole, the above left and right arm portions $\mathbf{10}_c$ and $\mathbf{10}_d$ are curved in three-dimensions and formed as complex shapes. These left and right arm portions $\mathbf{10}_c$ and $\mathbf{10}_d$ are welded at their ends to the rear end surfaces of the frame members 10*a* and 10*b*, where the connection positions thereof are selected to be Bessel points of the frame 10*a* and 10*b* or in the proximity thereof as determined in U.S. Pat. No. 3,638,063.

The grid apparatus 7 is attached to the inner peripheral surface of panel portion 3 of the cathode ray tube by way of stud pins not shown. Moreover, the grid apparatus 7 is provided with a temperture compensating means, not shown, which uses, for example, a bimetal mechanism to sense the temperature to permit, for example, the opening state of the left and right arm portions $\mathbf{10}_c$ and $\mathbf{10}_d$, each being formed as the U-shape to be adjusted, whereby in response to the expansion and contraction of the grid element 11 due to heat, the grid element 11 is always stretched at a predetermined tension.

Regarding the conventional grid apparatus for use with the color cathode ray tube as mentioned above, in order that the predetermined mechanical strength may be obtained, the thicknesses of its frame members 10*a* and 10*b* and the diameters and the thicknesses of the hollow pipes of the left and right arm portions 10*c* and 10*d* and so on are selected suitably. This leads to a remarkable increase of its weight. Moreover, as the cathode ray tube is made larger, mechanical strength must also be increased, so this causes its weight to be increased much more. As the weight thereof is increased, the accompanying attaching means and the temperature compensating means accompanying therewith also become large, which causes its weight to be increased still further. Furthermore, the shapes or configurations of the left and right arm portions 10*c* and 10*d* are appreciably complex, the manufacturing process is made complicated, and the space shared by the whole of the grid apparatus is increased.

OBJECTS AND SUMMARY OF THE INVENTION

Accordingly, is is an object of this invention to provide a grid apparatus for use with a color cathode ray tube which can obviate the aforesaid defects.

It is another object of this invention to provide a grid apparatus for use with a color cathode ray tube which can be formed compact and light-weight as a whole.

It is still another object of this invention to provide a grid apparatus for use with a color cathode ray tube which can be manufactured easily and at low cost.

It is a further object of this invention to provide a grid apparatus for use with a color cathode ray tube which can preserve a predetermined mechanical strength even though it is compact and light.

It is a still further object of this invention to provide a grid apparatus for use with a color cathode ray tube which can avoid displacement of the grid effectively.

It is yet a further object of this invention to provide a grid apparatus for use with a color cathode ray tube which can avoid displacement of the grid effectively.

According to an aspect of the present invention, there is provided a grid apparatus for use with a color cathode ray tube comprising a pair of opposing frame members, a grid element stretched between said pair of opposing frame members, and a pair of arm portions respectively welded at free ends thereof to said pair of opposing frame members for mechanically connecting said pair of opposing frame members, and for stretching said grid elements with a predetermined tension in cooperation with said pair of opposing frame members, in which each of said pair of arm portions is curved as a U-shape in substantially one plane, both ends thereof are connected to said pair of opposing frame members at positions outside from their Bessel points, the plane in which each of said pair of arm portions is arranged is respectively widened rearward with an angle from 45° to 65° with respect to a surface perpendicular to an axis of said grid apparatus, and a ratio $I_1/I_2$ between respective moments of inertia of area $I_2$ of said frame members and said arm portions is selected to be as a value ranging from 1.5 to 2.0.

The other objects, features and advantages of the present invention will become apparent from the following description taken in conjunction with the accompanying drawings throughout which the like references designate the same elements and parts.

DESCRIPTION OF THE PREFERRED EMBODIMENT

Figure 3:
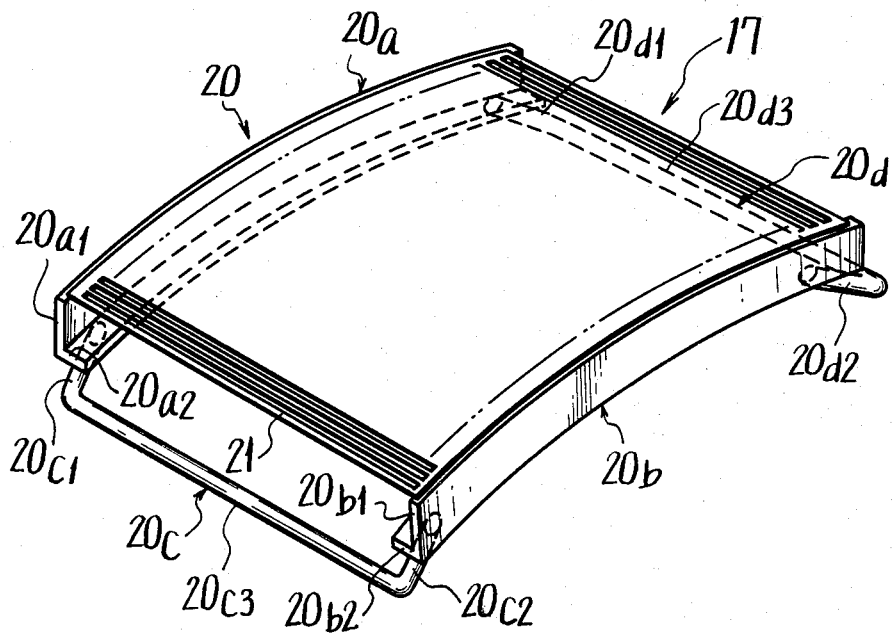
FIG. 3 is a perspective diagram showing an example of a grid apparatus according to the present invention.
Figure 4:
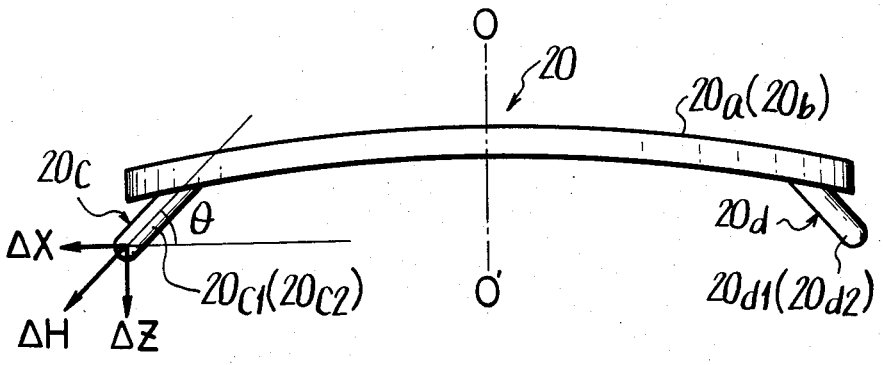
FIG. 4 is a side diagram thereof.

With reference to FIGS. 3 through 8, an embodiment of the present invention will be described in detail. Throughout the figures, reference numeral 17 denotes an overall arrangement of an example of the grid apparatus according to the present invention. FIG. 3 is a perspective diagram showing an example of the grid apparatus 17 according to the present invention; FIG. 4 is a side diagram thereof as viewed from the right foreground of FIG. 3; and a plan view as the grid would be positioned in service in a horizontally mounted cathode ray tube.

As shown in FIGS. 3 and 4, the example of the grid apparatus 17 of this invention comprises a frame 20 composed of a pair of frame members 20*a* and 20*b* opposing each other, and left and right arm portions 20*c* and 20*d*, respectively, positioned therebetween. Across the front surfaces of the opposing frame members 20*a* and 20*b* of the frame 20, that is, the end surfaces thereof adjacent and opposing the phosphor screen, there is sretched a grid element 21. This grid element 21 is formed of, for example, a thin metal plate through which a number of slits are formed in parallel to one another at a predetermined interval, by, for example, the selective etching technique mentioned above. Both end edges of this thin metal plate in the extending direction of the slits are welded to the end surfaces at the front sides of the frame members 20*a* and 20*b* of the frame 20 linearly along their longitudinal directions.

The frame members 20*a* and 20*b* of the frame 20 and the left and right arm portions 20*c* and 20*d* may be made of, for example, SCM415 of Cr-Mn-Mo steel. The frame members 20*a* and 20*b* are each formed as, for example, L-shape in cross-section similarly as described before, in which respective end surfaces of their plate portions $20_{a1}$ and $20_{b1}$ form arc surfaces constituting a common partial cylindrical surface, and the grid element 21 is stretched over these arc end surfaces thereby forming the cylindrical surface by the stretched surface of this grid element 21.

Particularly in accordance with the present invention, the left and right arm portions $20_c$ and $20_d$ are connected at the both ends thereof to these frame members $20_a$ and $20_b$ sufficiently outside from the Bessel points of the frame members $20_a$ and $20_b$. In other words, these left and right arm portions $20_c$ and $20_d$ are connected to the frame members $20_a$ and $20_b$ substantially near the ends thereof. While the arm portions $20_c$ and $20_d$ are formed of hollow metal pipes or tubing as described above, in accordance with the present invention the arm portions $20_c$ and $20_d$ are formed in a substantially two-dimensional curvature. That is, according to the present invention, each of the arm portions $20_c$ and $20_d$ is curved to form a U-shape as a whole lying substantially within one plane. These arm portions $20_c$ and $20_d$ are welded at their ends to the back surfaces of the plate portions $20_{a2}$ and $20_{b2}$ of the frame members $20_a$ and $20_b$, which are opposite to the sides over which the grid element 21 is stretched. These arm portions $20_c$ and $20_d$ also include between both end portions $20_{c1}$ $20_{c2}$ and $20_{d1}$, $20_{d2}$ extended rearward therefrom middle portions $20_{c3}$ and $20_{d3}$ stretched across both end portions $20_{c1}$, $20_{c2}$, and $20_{d1}$, $20_{d2}$, in parallel with each other with respect to the axial direction of the cylindrical surface formed by the grid element 11. Furthermore, as shown in FIG. 4, regarding both arm portions $20_c$ and $20_d$, each of the end portions $20_{c1}$, $20_{c2}$ and $20_{d1}$, $20_{d2}$ thereof is positioned so that an angle $\theta$ between the plane perpendicular to an axis O-O' of the grid apparatus 17 and the planes including them is selected to be an angle ranging from 45° to 60°, and the distance between the both end portions $20_c$ and $20_d$ is widened rearwards so as to prevent the middle portions $20_c$ 3 and $20_{d3}$ of these arm portions $20_c$ and $20_d$ from obstructing the path of the electron beam.

Further, according to the present invention, ratio $I_1/I_2$ between moment of inertia of area $I_1$ generated in the tension direction of the aforesaid grid element 21 of the frame members $20_a$ and $20_b$ in the frame 20, namely, in the direction to which the turn buckle is supplied and like moment of inertia of area $I_2$ generated of the arm portions $20_c$ and $20_d$ is selected to be a value from 1.5 to 2.0 preferably from 1.70 to 1.80.

The grid element 21 is stretched over the aforementioned frame 20 under the state that loads for drawing both of the frame members $20_a$ and $20_b$ near to each other from the outside of both the frame members $20_a$ and $20_b$, namely the so-called turn buckle is applied thereto. In this case, as shown by characters $\vec{A}_1$, $\vec{A}_2$, $\vec{A}'_1$, $\vec{A}'_2$, $\vec{B}_1$, $\vec{B}_2$, $\vec{B}'_1$ and $\vec{B}'_2$ in FIG. 5, the respective frame members $20_a$ and $20_b$ are loaded at four points inside the position of the arms 20c and 20d. Then, while the respective frame members $20_a$ and $20_b$ and arm portions $20_c$ and $20_d$ are deformed, the grid element 21 is stretched and welded over both of the frame members $20_a$ and $20_b$. When these loads are released, in order to supply a predetermined tension to the whole grid element 21 by the dynamic stabilities of the respective frame members $20_a$ and $20_b$ and the arm portions $20_c$ and $20_d$, the magnitudes and operation points of the respective loads $\vec{A}_1$, $\vec{A}_2$. . . $\vec{B}'_1$, $\vec{B}'_2$ are suitably selected.

As stated above, in accordance with the present invention, each of the arm portions $20_c$ and $20_d$ is formed in the two-dimension or as the U-shape curved within substantially one plane so that the rigidity is increased much more than the conventional prior art arm portions in three dimension. If the rigidity of the arm portions 20c and 20d is much increased, the frame members 20a and 20b are apt to be deformed plastically when turn buckle is applied thereto. In order to eliminate such defect, the moment of inertia of area of the arm portions 20c and 20d should be reduced about 35% as compared to the conventional arm portions 10c and 10d. Thus as to the hollow metal pipe constituting these arm portions $20_c$ and $20_d$ a hollow pipe more slender and/or thinner than the conventional one can be used, and in addition, the whole length of the arm portions $20_c$, $20_d$, is shortened by the curved two-dimensional shape so that the amount of the material required in the manufacturing of the grid apparatus can be reduced and the grid apparatus according to the present invention can be made more compact and lightweight.

Figure 1:
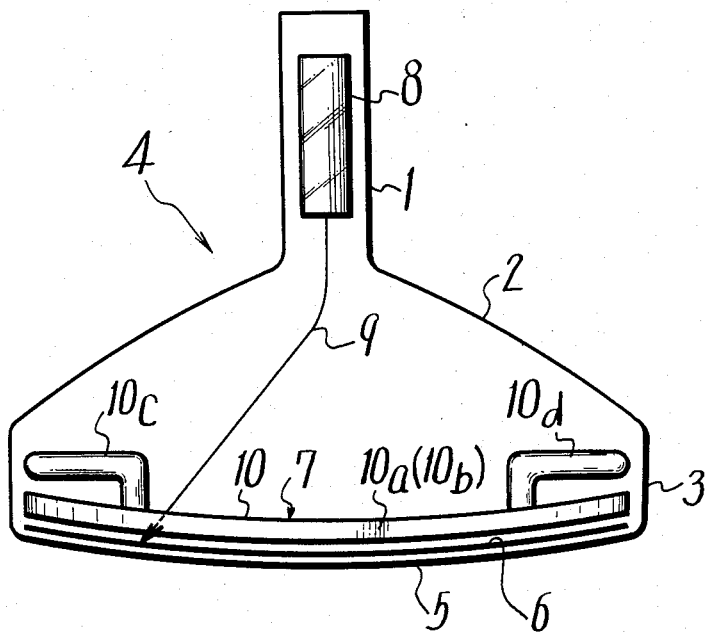
FIG. 1 (PRIOR ART)
FIG. 1 is a schematic diagram showing a prior art color cathode ray tube used to explain the present invention.
Figure 2:
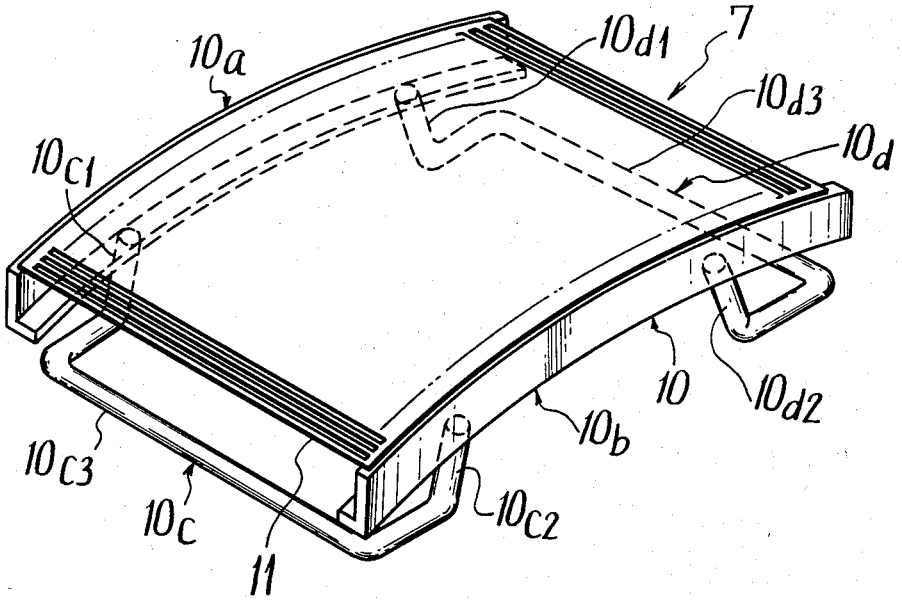
FIG. 2 (PRIOR ART)
FIG. 2 is a perspective diagram showing a prior art grid apparatus.
Figure 5:
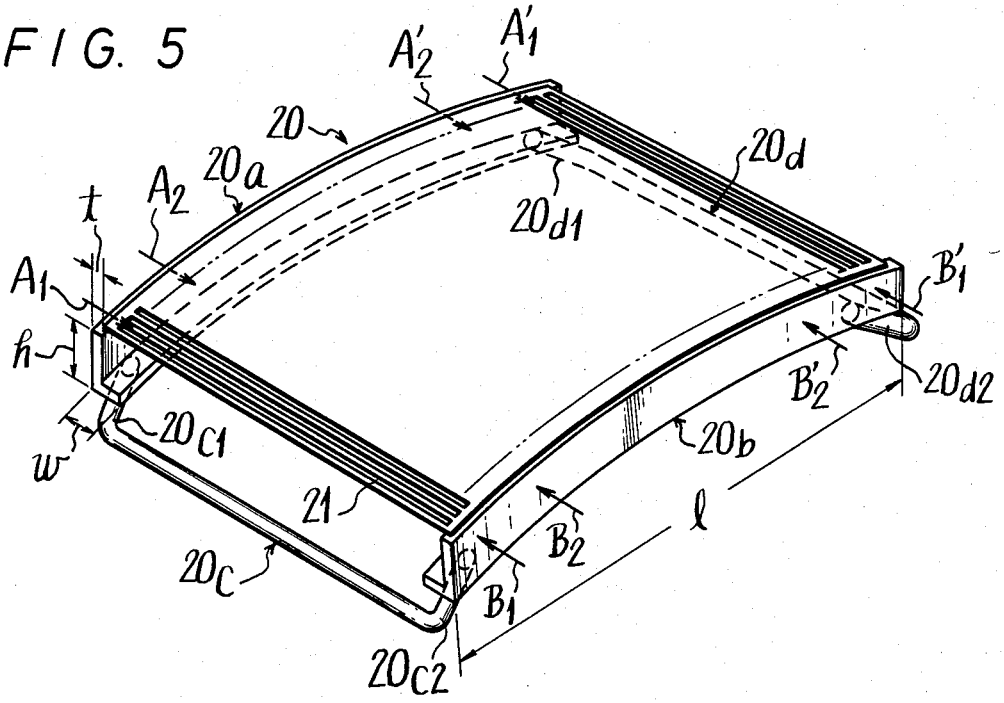
FIG. 5 is an explanatory diagram thereof.

With the arrangement of the present invention, as described above both the arm portions $20_c$ and $20_d$ are connected to the frame members $20_a$ and $20_b$ at positions outside from the Bessel points, which means that the grid element 21 does not obtain the predetermined tension distribution. However, in accordance with the present invention, the ratio $I_1/I_2$ between the respective moments of inertia of area of the frame members $20_a$, $20_b$ and the arm portions $20_c$ and $20_d$ is selected to be a value ranging from 1.5 to 2.0 as described hereinbefore, by which it is found that the predetermined tension distribution for the grid element is achieved. That is, if the ratio $I_1/I_2$ exceeds 2.0, the rigidities of the arm portions $20_c$ and $20_d$ are so small as compared with those of the frame members $20_a$ and $20_b$ that the grid element 21 is difficult to be stretched therebetween with sufficient tension. Whereas, if the ratio $I_1/I_2$ is not more than 1.5, the rigidities of the arm portions $20_c$ and $20_d$ are so large that the desired predetermined turn buckles or displacements of the frame members $20_a$ and $20_b$ made by the external loads when the grid element 21 is stretched with tension are not produced. Thus, it is quite difficult to stretch the grid element 21 with the predetermined tension distribution. However, when the ratio $I_1/I_2$ stays in the range from 1.5 to 2.0, it was ascertained that the grid element 21 can be stretched between the frame members $20_a$ and $20_b$ with the desired tension distribution. By way of example, 20-inch type frame 20 is made of like SCM415 mentioned above. In the case where the distance from the end of the frame 20 to the Bessel point is B, then B/L equals 0.223 where L is a range over which the load is applied, as set forth in U.S. Pat. No. 3,638,063. In this example, as shown in FIG. 5, a length l of each of the frame members $20_a$ and $20_b$ formed L-shape in cross section is given as 390 mm, a thickness t thereof is 5 mm, a height h of the plate portion over which the grid element 21 is stretched is 28 mm, a width w of the other plate portion is given as 21 mm, and each of the arm portions $20_c$ and $20_d$ is formed of a pipe whose outer diameter is 19 mm and the wall thickness of which is 2.5 thus forming the grid apparatus 17 according to the present invention. Accordingly, $I_1$ for this configuration is 7611 $mm^4$ and $I_2$ is 4511 $mm^4$ or $I_1/I_2=1.7$. On the other hand, in the grid apparatus 7 of the conventional prior art arrangement shown in FIG. 2, each of the frame members $10_a$ and $10_b$ of the frame 10 is formed of a material, a size and a shape the same as those of the grid apparatus according to the present invention. But, while the arm portions $10_c$ and $10_d$ of the conventional grid apparatus are formed of like materials, they are formed of a tube or pipe whose outer diameter is 21 mm and the wall thickness of which is 2.8 mm providing an $I_2$ of 6786 $mm^4$ and $I_1/I_2=1.1$.

Figure 6:
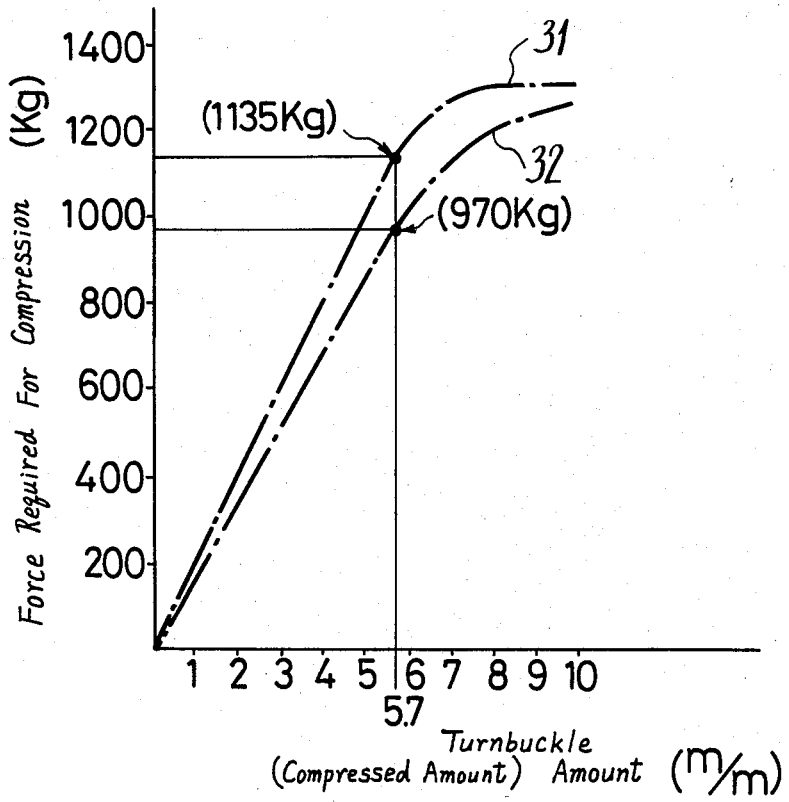
FIGS. 6 and 7 are graphs showing measured mechanical characteristics thereof.
Figure 7:
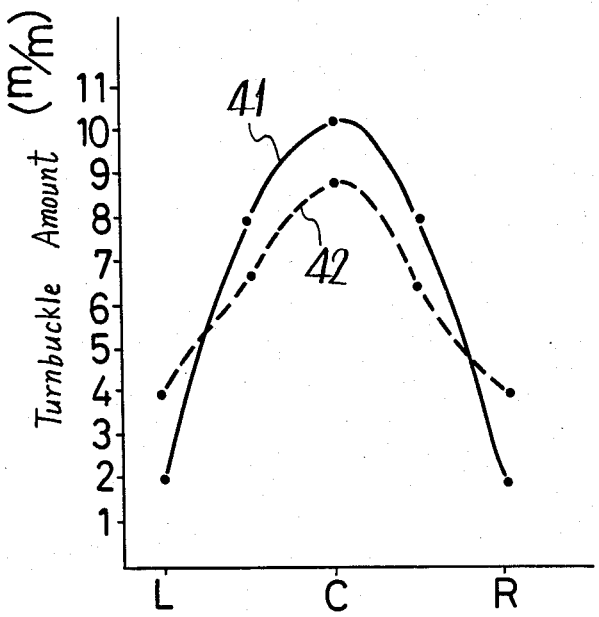

The grid apparatus 17 according to the present invention was compared with the prior art grid apparatus 7. In the graph of FIG. 6 showing the comparison result, the bends of these frames 20 and 10 are measured as shown by curves 31 and 32 in the graph of FIG. 6. In the graph of FIG. 6, the abscissa indicates the turn buckle amounts of the frames 20 and 10, namely the deflection amounts of the frames 20 and 10 due to the loads from the outside of the respective frame members $20_a$, $20_b$ and $10_a$, $10_b$ with respect to the directions along which the loads are applied, while the ordinate thereof indicates the loads required to obtain these deflection amounts. From a comparison of the curve 31 with the curve 32, it is seen that where the same turn deflection (normally, 5.7 mm) is obtained in these two cases, the grid apparatus 17 according to the present invention requires a larger load than that of the conventional grid apparatus 7. Thus, the frame has a larger rigidity and hence, the grid element of the present invention stretched with the above-mentioned turn buckle can be stretched with larger tension. The above measurements are carried out at the positions representative of the left and right turn buckles. The frame 20 is applied with the loads for the turn buckles at the four points of the respective frame members $20_a$ and $20_b$ as shown in FIG. 5, where the distance between adjacent operating points of the loads $\vec{A}_2$, $\vec{A}'_2$ and $\vec{B}_2$ $\vec{B}'_2$ is selected to be 210 mm, and the distance between the adjacent operating points of the loads $\vec{A}_1$, $\vec{A}_2$; $\vec{A}'_2$ $\vec{A}'_1$; $\vec{B}_1$, $\vec{B}_2$; and $\vec{B}'_2$, $\vec{B}'_1$ is selected to be 75 mm. Whereas, the frame 10 is loaded at its two points near the Bessel points of the frame members $\mathbf{10}_a$ and $\mathbf{10}_b$. Moreover, the turn buckle amounts under the loaded state in these frames 10 and 20 are distributed as shown by curves 42 and 41 in the graph of FIG. 7. In the graph of FIG. 7, positions denoted by L and R on the abscissa indicate each of the left and rights ends of the frames 10 and 20, and a position denoted by C thereon indicates each of the central positions thereof. Comparing these curves 41 and 42 to each other, in the case of the grid apparatus according to the present invention, the distribution, curve 41, thereof is made rapidly steeper as compared with that of the prior art grid apparatus. But, the turn buckle amount 2 mm is obtained at both end positions L and R, and practically for the grid apparatus of 20-inch type it is sufficient to achieve a turn buckle amount more than 0.8 mm, at the positions L and R. This means that no trouble in the grid apparatus according to the present invention is caused.

As stated above, in the present invention, under the state that the frame 20 is applied at its frame members $\mathbf{20}_a$ and $\mathbf{20}_b$ with the turn buckles to apply the loads from the outside, the grid element 21 is stretched therebetween. In this case, in the arm portions $\mathbf{20}_c$ and $\mathbf{20}_d$, as shown in FIG. 4, there are brought about displacements $\Delta H$ along the directions to which the end portions $\mathbf{20}_{c1}$ and $\mathbf{20}_{d1}$ of the arm portions $\mathbf{20}_c$ and $\mathbf{20}_d$ are extended. These displacements $\Delta H$ are distributed by the inclination angle $\theta$ of the arm portions $\mathbf{20}_c$ and $\mathbf{20}_d$ into displacements $\Delta x$ in the horizontal direction along the plane perpendicular to the axis O-O' and displacements $\Delta Z$ perpendicular to the above displacements $\Delta x$.

In the case of manufacturing and assembling the cathode ray tube, in association with frit seals, exhausts, agings and the like of the respective parts, the grid apparatus is subjected to a thermal cycle such as heating and cooling. Also, after the assembly thereof, the electron beam impinges on the grid apparatus thereby heating the same. Thus, the frame 20 is deformed by the expansion and contraction thereof. By this deformation, the aforementioned displacements $\Delta x$ and $\Delta Z$ are caused. But, since the displacement $\Delta Z$ causes the distance between the grid apparatus and the phosphor screen and the inclination therebetween to be varied, this is not desirable.

Figure 8:
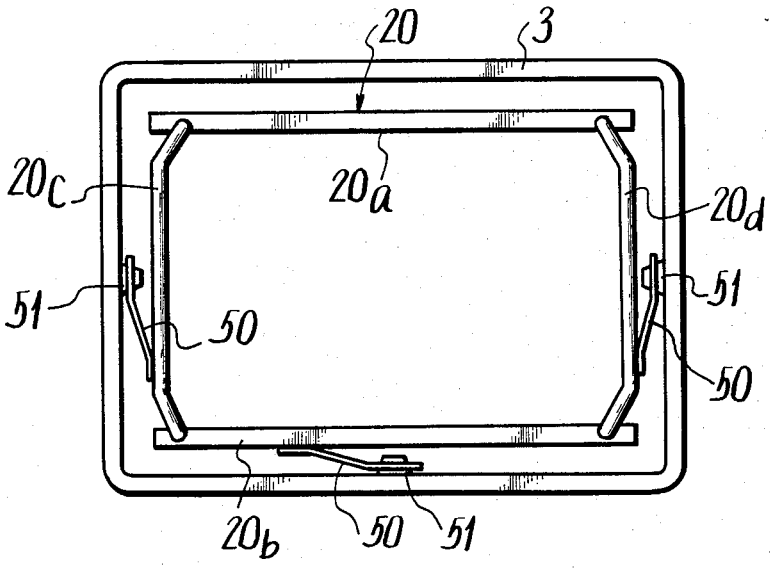
FIG. 8 is a rear diagram showing the attaching state of the grid apparatus according to one example of the present invention to a panel portion in a cathode ray tube.

As shown in FIG. 8, similarly to the ordinary prior art grid apparatus, the grid apparatus according to the present invention is supported and attached at these points to the inner surface of the peripheral portion (skirt portion) of the panel portion 3 in the cathode ray tube envelope. That is, by way of example, one end of each of leaf springs 50 is welded to the arm portions $\mathbf{20}_c$, $\mathbf{20}_d$ and the frame members $\mathbf{20}_b$ of the frame 20, respectively, and at the inner surfaces of the panel portion 3 opposing to those arm portions $\mathbf{20}_c$, $\mathbf{20}_d$, and the frame members $\mathbf{20}_b$, are frit-connected stud pins 51, each formed as a frusto conical shape. These stud pins 51 are respectively engaged into through-holes, not shown, formed of, for example, triangular shapes and bored through the free ends of the leaf springs 50. The engagements of the leaf springs 50 with the stud pins 51 ensure support of the grid apparatus. In this case, the displacement $\Delta x$ accompanying the deformation of the aforesaid frame 20 can be absorbed by the deformation of the leaf springs 50, while the displacement $\Delta Z$ causes an inclination where the distance between the frame 20 and the phosphor screen differs at the portions $\mathbf{20}_a$ and $\mathbf{20}_b$ particularly in the case of the support provided at three points as described above. Therefore, in order to distribute the displacement $\Delta H$ caused by the deformation of the frame 20 as much as possible into the displacement $\Delta x$ it is preferred that the attaching angle $\theta$ of the arm portions $\mathbf{20}_c$ and $\mathbf{20}_d$ is as small as possible. In this case, if the angle $\theta$ is too small, the arm portions $\mathbf{20}_c$ and $\mathbf{20}_d$ are protruded sideward so much that the width of the overall arrangement of the grid apparatus is widened. In addition, the inclinations of the end surfaces where the arm portions $\mathbf{20}_c$ and $\mathbf{20}_d$ are welded to the frame members $\mathbf{20}_a$ and $\mathbf{20}_b$ are increased with the opening of the pipe becoming large and the welded area is overly increased. In accordance with the present invention, the attaching angle $\theta$ of the arm portions $\mathbf{20}_c$ and $\mathbf{20}_d$ is selected to be the value from 45° to 60°. The above definition of the angle $\theta$ avoids the problems of the displacement, size of the frame and the problem of the welding.

The frame 20 is provided at its arm portions $\mathbf{20}_c$ and $\mathbf{20}_d$ with a temperature compensating means formed of, for example, a bimetal mechanism of the prior art, not shown, by which, when the grid apparatus is heated by the impingement of, for example, the electron beam resulting in the expansion of the grid element 21, the U-shaped curvatures of the arm portions $\mathbf{20}_c$ and $\mathbf{20}_d$ are widened or moved apart so as to lessen the degrees of the curvatures. Thus, the grid element 21 can preserve the predetermined tension at any time.

As stated above, since in the present invention both of the arm portions $\mathbf{20}_c$ and $\mathbf{20}_d$ are formed as curvatures of two dimension, the connection positions of these arm portions $\mathbf{20}_c$ and $\mathbf{20}_d$ to the frame members $\mathbf{20}_a$ and $\mathbf{20}_b$ are selected to be at both end portions outside of the Bessel points thereof, and the angles $\theta$ of the plane determined by the arm portion $\mathbf{20}_c$ and $\mathbf{20}_d$ with respect to a surface perpendicular to an axis of the grid apparatus are selected to be the angle from 45° to 60°, the whole of the grid apparatus can be formed as much more light-weight, the manufacturing thereof can be carried out easily, the costs of materials and assembly can be reduced, and further the displacement of the grid element and the like can be carried out effectively. Thus, there are brought about large advantages for the color cathode ray tube by which a good picture can be produced.

The above description is given on a single preferred embodiment of the invention, but it will be apparent that many modifications and variations could be effected by one skilled in the art without departing from the spirit or scope of the novel concepts of the invention so that the scope of the invention should be determined by the appended claims only.

We claim as our invention:

1. A grid apparatus for use with a color cathode ray tube comprising a pair of opposing frame members, a grid element stretched between said pair of opposing frame members, and a pair of arm portions respectively fixed at free ends thereof to said pair of opposing frame members for mechanically connecting said pair of opposing frame members, and for stretching said grid element with a predetermined tension in cooperation with said pair of opposing frame members, in which each of said pair of arm portions is curved as a U-shape in a substantially single plane, both ends thereof are connected to said pair of opposing frame members at positions outside from their Bessel points, the plane in which each of said pair of arm portions is arranged is respectively widened rearward with an angle from 45° to 65° with respect to a surface perpendicular to the axis of said cathode ray tube, and a ratio $I_1I/hd$ 2 is selected to be a value ranging from 1.5 to 2.0 where $I_1$ is the moment of inertia of the area of said frame members and $I_2$ is the moment of inertia of the area of said arm portions.

2. An apparatus according to claim 1, in which said pair of arm portions are constructed of tubular pipe.

* * * * *